US009630204B2

(12) United States Patent
Hung

(10) Patent No.: US 9,630,204 B2
(45) Date of Patent: Apr. 25, 2017

(54) PLUNGER FOR CAULKING GUN

(71) Applicant: Siang Syuan Fu Industry Co., Ltd., Changhua (TW)

(72) Inventor: Hung Chih Hung, Changhua (TW)

(73) Assignee: Siang Syuan Fu Industry Co., Ltd., Changhua (TW)

( * ) Notice: Subject to any disclaimer, the term of this patent is extended or adjusted under 35 U.S.C. 154(b) by 101 days.

(21) Appl. No.: 14/696,656

(22) Filed: Apr. 27, 2015

(65) Prior Publication Data

US 2016/0310983 A1 Oct. 27, 2016

(51) Int. Cl.
*B67D 7/60* (2010.01)
*B05C 17/005* (2006.01)
*B05C 17/01* (2006.01)

(52) U.S. Cl.
CPC ..... *B05C 17/00576* (2013.01); *B05C 17/01* (2013.01)

(58) Field of Classification Search
CPC ..... B05C 17/005; B05C 17/00576; B05C 17/00533; B05C 17/00543; B05C 17/01; B05C 17/0103; B05C 17/012; B05C 17/015; B05C 17/0116; B05C 17/00596
USPC ..... 97/187, 188
See application file for complete search history.

(56) References Cited

U.S. PATENT DOCUMENTS 1,536,477 A * 5/1925 Crewe ..... B05C 17/0123 222/391
2,115,591 A * 4/1938 Sherbondy ..... B05C 17/0123 222/327
2,387,106 A * 10/1945 Allen ..... E21B 33/062 251/1.3
2,920,797 A * 1/1960 Sherbondy ..... B05C 17/00576 222/327
4,197,967 A * 4/1980 Baur ..... B05C 17/00576 222/190
4,311,258 A * 1/1982 Bradshaw ..... B05C 17/00576 141/383
4,678,107 A * 7/1987 Ennis, III ..... A61M 5/31511 222/386.5
5,156,305 A 10/1992 Eyre
5,381,931 A 1/1995 Chang
5,626,263 A 5/1997 Lii
5,775,539 A 7/1998 Bates et al.
5,887,765 A 3/1999 Broesamle
5,909,830 A 6/1999 Bates et al.
(Continued)

*Primary Examiner* — Patrick M Buechner
(74) *Attorney, Agent, or Firm* — Muncy, Geissler, Olds & Lowe, P.C.

(57) ABSTRACT

A caulking gun includes a stock having a handle, a piston rod slidably attached to the stock and movable forwardly and rearwardly relative to the stock, the piston rod includes a front portion, and a plunger attached to the front portion, the plunger including a head attached to the front portion, and the plunger including a pusher having an opening formed in an upper portion of the pusher for receiving and engaging with the head and for securing the head to the pusher. The pusher includes an inner peripheral channel formed in the upper portion and communicating with the opening of the pusher for receiving and engaging with the head. The pusher includes a spring latch on the upper portion for engaging with the head and for locking the head to the pusher and for preventing the pusher from being disengaged from the head.

4 Claims, 2 Drawing Sheets

(56) References Cited

U.S. PATENT DOCUMENTS

| | | | | |
|---|---|---|---|---|
| 6,178,873 | B1 * | 1/2001 | Pierobon | F04B 39/0005 92/187 |
| 6,691,899 | B2 | 2/2004 | Sung | |
| 7,011,238 | B1 | 3/2006 | Sung | |
| 2003/0116590 | A1 * | 6/2003 | Lord | B05C 17/002 222/389 |
| 2009/0020561 | A1 * | 1/2009 | Keller | B05C 17/00553 222/137 |

* cited by examiner

PLUNGER FOR CAULKING GUN

BACKGROUND OF THE INVENTION

1. Field of the Invention

The present invention relates to a caulking gun or fluid dispensing gun, and more particularly to a caulking gun or fluid dispensing gun including an improved structure or configuration for allowing the plunger to be easily and quickly attached or mounted or secured to the piston rod.

2. Description of the Prior Art

Various kinds of typical caulking guns or fluid dispensing guns have been developed and provided for receiving or engaging with the dispensing cartridges or packages and for depressing or squeezing or operating the dispensing cartridges or packages to release or dispense the fluid or liquid contained in the dispensing cartridges or packages.

For example, U.S. Pat. No. 5,156,305 to Eyre, U.S. Pat. No. 5,381,931 to Chang, U.S. Pat. No. 5,626,263 to Lii, U.S. Pat. No. 5,775,539 to Bates et al., U.S. Pat. No. 5,887,765 to Broesamle, U.S. Pat. No. 5,909,830 to Bates et al., U.S. Pat. No. 6,691,899 to Sung, and U.S. Pat. No. 7,011,238 to Sung disclose several of the typical caulking guns or fluid dispensing guns each comprising a component supporting bracket for receiving or engaging with or for supporting a fluid or liquid dispensing cartridge or package and for dispensing the fluid or liquid contained in the dispensing cartridge or package out through a mouth of the dispensing cartridge, and normally comprising a piston rod having a plunger attached to the front or free end portion of the piston rod for engaging with and for pushing or forcing the fluid or liquid to flow out of the mouth of the dispensing cartridge or package with a trigger or the like.

However, the plunger is normally attached or secured to the front or free end portion of the piston rod with bolts or screws or fasteners, and normally it takes time to thread and unthread the screws onto and from the piston rod; or, the plunger is solidly attached or secured to the piston rod with welders or adhesive materials such that the plunger of the typical caulking guns or fluid dispensing guns may only be used to engage with a specific dispensing cartridge or package of a predetermined size or volume or standard, and the other typical caulking guns or fluid dispensing guns are required for engaging with the other dispensing cartridges or packages.

The present invention has arisen to mitigate and/or obviate the afore-described disadvantages of the conventional caulking guns or fluid dispensing guns.

SUMMARY OF THE INVENTION

The primary objective of the present invention is to provide a caulking gun including an improved structure or configuration for allowing the plunger to be easily and quickly attached or mounted or secured to the piston rod and for allowing the plunger to engage with different dispensing cartridges.

In accordance with one aspect of the invention, there is provided a caulking gun comprising a stock including a handle extended therefrom; a piston rod slidably attached to the stock and movable forwardly and rearwardly relative to the stock, the piston rod including a front portion; and a plunger attached to the front portion of the piston rod, the plunger including a head attached to the front portion of the piston rod, and the plunger including a pusher having an opening formed in an upper portion of the pusher for receiving and engaging with the head and for securing the head to the pusher and for allowing different pusher to be easily and quickly changed or adjusted and attached to the head without changing or replacing the piston rod; i.e., only the pusher is required to be selected and attached to the head without fasteners and tools.

The pusher includes an inner peripheral channel formed in the upper portion of the pusher and communicating with the opening of the pusher for slidably receiving and engaging with the head and for guiding the head to move relative to the pusher.

The pusher includes a spring latch provided on the upper portion of the pusher for engaging with the head and for locking the head to the pusher and for preventing the pusher from being disengaged from the head, and arranged for allowing the pusher to be easily and quickly attached or mounted or secured to the head of the plunger.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
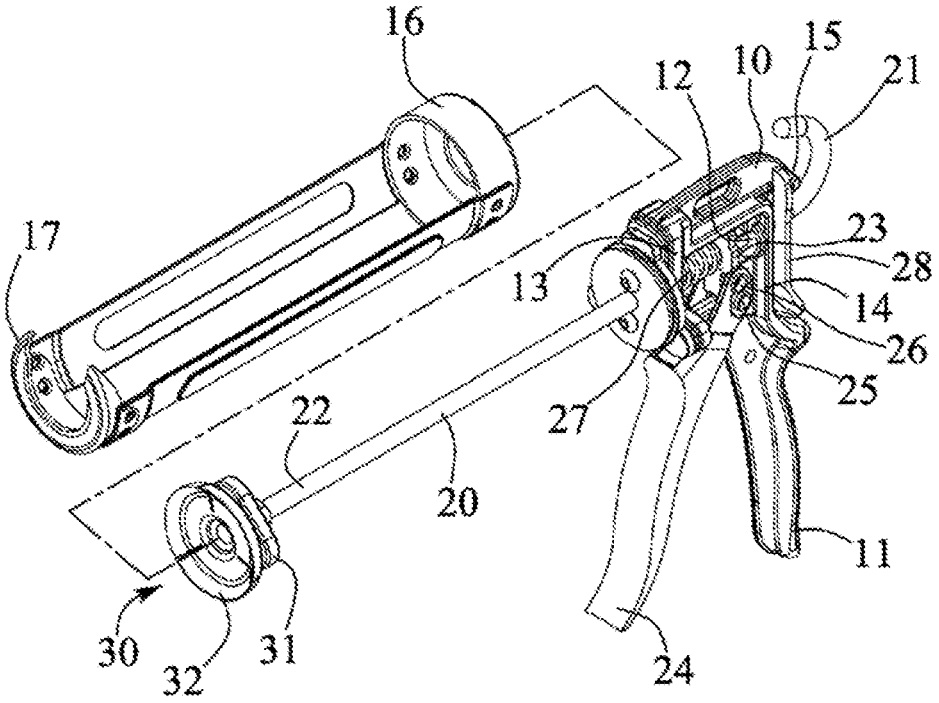
FIG. 1 is a partial exploded view of a caulking gun in accordance with the present invention.

Referring to the drawings, and initially to FIG. 1, a caulking gun in accordance with the present invention comprises a trigger stock 10 including a handle 11 extended downwardly and generally perpendicularly to the longitudinal axis of the stock 10, and including a chamber 12 formed therein, such as formed in the middle portion thereof, and defined between a front wall 13 and a rear wall 14, and the stock 10 includes an abutment 15 extended rearwardly or laterally from the upper rear portion thereof. A piston rod 20 is slidably received and engaged through the walls 13, 14 of the stock 10, and movable forwardly and rearwardly relative to the stock 10, and includes a curved hand grip 21 extended or provided on the rear portion thereof with which the piston rod 20 may be moved longitudinally relative to the stock 10, and includes a front end portion 22.

A frame 16 is attached or secured to or extended forwardly from the front portion of the stock 10, and includes a ring 17 secured to the front end of the frame 16 for receiving and holding a cartridge (not illustrated) which includes a generally cylindrical shape for containing fluid or viscous materials therein, such as the caulking mastic materials. A plunger 30 is attached to the front end portion 22 of the piston rod 20 and may be engaged with a piston (not illustrated) that is provided in the cartridge for selectively moving the piston along the cartridge, and thus for forcing the fluid or viscous materials out of the cartridge. An actuating plate 23 is loosely and slidably engaged onto the piston rod 20 and received and engaged in the chamber 12 of the stock 10.

A trigger 24 has an upper portion rotatably or pivotally secured to the stock 10 or the handle 11 with such as a pivot axle 25, and includes an actuating pin 26 provided on the upper end of the trigger 24 for selectively engaging with the actuating plate 23. A compression spring member 27 is engaged around the piston rod 20, and received in the chamber 12 of the stock 10, and engaged between the actuating plate 23 and the front wall 13 of the stock 10, for biasing the actuating plate 23 leftwardly or rearwardly to engage with the actuating pin 37 of the trigger 24. In operation, the actuating plate 23 may be tilted relative to the piston rod 20 by the actuating pin 37 and thus may engage and hold or grasp the piston rod 20, in order to move the piston rod 20 incrementally when the lower portion of the actuating plate 23 is forced or moved forward by the actuating pin 37 of the trigger 24. The actuating plate 23 may be moved or biased rearwardly by the spring member 27, and thus the trigger 24 may be moved away from the handle 11 by the spring member 27 when the trigger 24 is released.

However, it is to be noted that the actuating pin 37 may still be engaged with the lower portion of the actuating plate 23 and thus may still tilt the actuating plate 23 relative to the piston rod 20 when the actuating plate 23 is moved rearwardly by the spring member 27, such that the piston rod 20 may also be moved rearwardly by the actuating plate 23 when the actuating plate 23 is moved rearwardly by the spring member 27. A release plate 28 is loosely engaged onto the piston rod 20 and loosely anchored in relation to the stock 10 by the laterally extended abutment 17 projecting from the rear portion of the stock 10, for selectively engaging with the piston rod 20 and for preventing the piston rod 20 from moving rearwardly relative to the release plate 28 and for allowing the piston rod 20 to move forwardly relative to the release plate 28. The above-described configuration is typical and has been disclosed in U.S. Pat. No. 6,691,899 to Sung which may be taken as a reference for the present invention.

Figure 2:
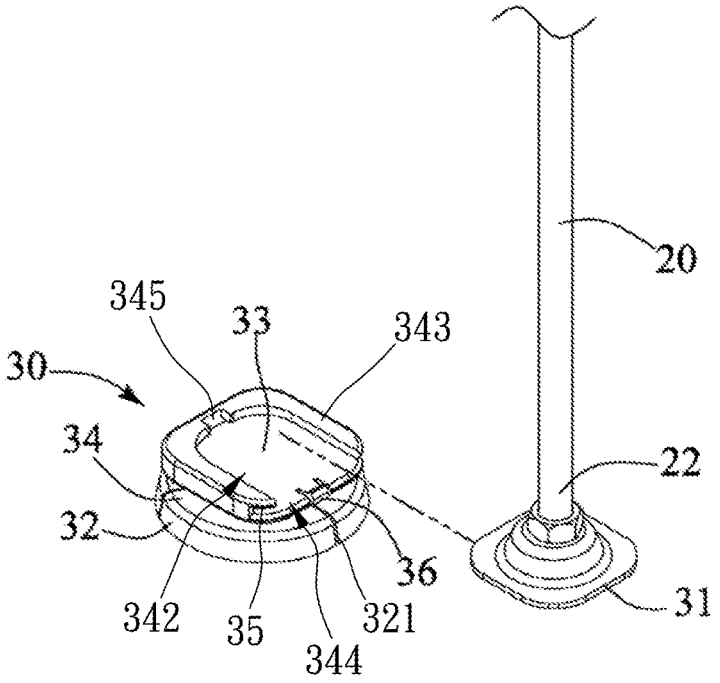
FIG. 2 is another partial exploded view of the caulking gun, illustrating the operation of the caulking gun.

As shown in FIGS. 1 and 2, the plunger 30 includes a head 31 attached or mounted or secured to the front end portion 22 of the piston rod 20, and includes a pusher 32 to be easily and quickly attached or mounted or secured to the head 31. For example, the pusher 32 includes an opening 33 formed or provided in the upper portion 34 thereof, and includes an inner peripheral channel 35 also formed or provided in the upper portion 34 thereof and communicating with the opening 33 of the pusher 32 for selectively receiving or engaging with the head 31 and for allowing the head 31 to be easily and quickly attached or mounted or secured to the pusher 32. The plunger 30 may further include a spring latch 36 formed or provided on the upper portion 34 of the pusher 32 for selectively engaging with the head 31 and for selectively latching or locking the head 31 to the pusher 32 and for preventing the pusher 32 from being disengaged or separated from the head 31 inadvertently. The pusher 32 may be disengaged or separated or removed from the head 31 by pushing the spring latch 36 relative to the pusher 32 by the user, for example. Specifically, the head 31 is plate-shaped and extends laterally relative to the piston rod 20. The upper portion 34 includes a receiving space 342 and a lip 343 protruding from a periphery of the receiving space 342, the lip 343 defines an inner peripheral channel 35 thereunder and communicating with the receiving space 342, and relative to the piston rod 20 the inner peripheral channel 35 and the receiving space 342 are laterally open toward a same lateral side of the upper portion 34 to form a receiving mouth 344. The head 31 is laterally engageable within the inner peripheral channel 35 via the receiving mouth 344 directly and blockable by the lip 343 in a direction parallel to the piston rod 20, and the head 31 is laterally disengageable from the inner peripheral channel 35 via the receiving mouth 344 directly. The spring latch 36 protrudes within the receiving mouth 344 for engaging with said head 31 and for locking said head 31 to said pusher 32 and for preventing said pusher 32 from being disengaged from said head 31. Said pusher 32 further includes a plurality of slits 321 extending and opening radially on an end opposite to the upper portion 34. The lip 343 is U-shaped and includes a breach 345 communicating with the opening.

In operation, as shown in FIG. 2, the head 31 may be easily and quickly engaged into the opening 33 and the peripheral channel 35 of the pusher 32, and thus easily and quickly attached or mounted or secured to the pusher 32. The latch 36 may be selectively engaged with the head 31 for selectively latching or locking the head 31 to the pusher 32 and for preventing the pusher 32 from being disengaged or separated from the head 31.

Figure 3:
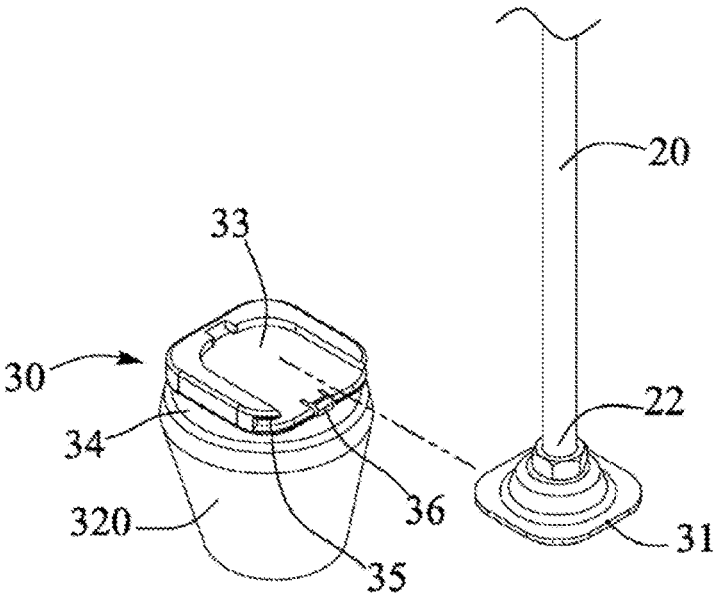
FIG. 3 is a further partial exploded view similar to FIG. 2, illustrating the other arrangement of the caulking gun.

As shown in FIG. 3, the plunger 30 may include another pusher 320 having a shape or contour or structure or configuration different from that shown in FIGS. 1 and 2 for selectively engaging with different cartridge (not illustrated) and for allowing the different pusher 32, 320 to be easily and quickly changed or adjusted and attached to the head 31, and for allowing the different pusher 32, 320 to engage with different cartridge (not illustrated).

Accordingly, the caulking gun in accordance with the present invention includes an improved structure or configuration for allowing the plunger to be easily and quickly attached or mounted or secured to the piston rod, the plunger includes a head attached to the piston rod and a pusher arranged to be easily and quickly attached to the head without fasteners and tools.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A caulking gun comprising:

a stock including a handle extended therefrom;

a piston rod slidably attached to said stock and movable forwardly and rearwardly relative to said stock, said piston rod including a front portion; and a plunger attached to said front portion of said piston rod, said plunger including a head which is plate-shaped, attached to said front portion of said piston rod and extends laterally relative to the piston rod, and said plunger including a pusher having an opening formed in an upper portion of said pusher for receiving and engaging with said head and for securing said head to said pusher;

wherein the upper portion further includes a receiving space and a lip protruding from a periphery of the receiving space the lip defines an inner peripheral channel thereunder and communicating with the receiving space, and relative to the piston rod the inner peripheral channel and the receiving space are laterally open toward a same lateral side of the upper portion to form a receiving mouth;

wherein the head is laterally engageable within the inner peripheral channel via the receiving mouth directly and blockable by the lip in a direction parallel to the piston rod, and the head is laterally disengageable from the inner peripheral channel via the receiving mouth directly.

2. The caulking gun as claimed in claim 1, wherein said pusher includes a spring latch provided on said upper portion of said pusher and protruding within the receiving mouth for engaging with said head and for locking said head to said pusher and for preventing said pusher from being disengaged from said head.

3. The caulking gun as claimed in claim 1, wherein said pusher further includes a plurality of slits extending and opening radially on an end opposite to the upper portion.

4. The caulking gun as claimed in claim 1, wherein the lip is U-shaped and includes a breach communicating with the opening.

* * * * *